United States Patent [19]

Endebrock

[11] Patent Number: 4,834,777

[45] Date of Patent: May 30, 1989

[54] FUEL PELLETIZING APPARATUS AND METHOD

[75] Inventor: Ed Endebrock, Lewiston, Id.

[73] Assignee: Hydraulic Services, Inc., Lewiston, Id.

[21] Appl. No.: 149,502

[22] Filed: Jan. 28, 1988

[51] Int. Cl.[4] ..... C10L 5/06; B30B 7/00

[52] U.S. Cl. ..... 44/596; 44/13; 44/629; 100/93 P; 100/237; 100/240

[58] Field of Search ..... 44/11-13, 44/629, 596; 100/41, 93 P, 237, 240, 906

[56] References Cited

U.S. PATENT DOCUMENTS

| | | | |
|---|---|---|---|
| 264,100 | 1/1882 | Prescott | 264/320 |
| 956,902 | 5/1910 | McCan | 44/13 |
| 959,870 | 5/1910 | McCan | 44/10 B |
| 1,908,689 | 6/1933 | Carpenter | 44/10 A |
| 4,015,951 | 3/1977 | Gunnerman | 44/10 E |
| 4,049,390 | 9/1977 | Furman | 44/13 |
| 4,119,025 | 10/1978 | Brown | 100/906 |
| 4,230,459 | 4/1980 | Moreau et al. | 44/10 B |
| 4,308,033 | 2/1981 | Gunnerman | 44/6 |
| 4,324,561 | 3/1982 | Dean et al. | 44/10 E |
| 4,398,917 | 3/1983 | Reilly | 44/10 B |
| 4,561,860 | 10/1985 | Gulley et al. | 44/10 R |

OTHER PUBLICATIONS

Wilson, Frank W., Editor/American Society of Tool and Manufacturing Engineers, *Fundamentals of Tool Design*, Prentice-Hall, Inc. (1962).

*Primary Examiner*—Carl F. Dees
*Attorney, Agent, or Firm*—Wells, St. John & Roberts

[57] ABSTRACT

Fuel pellets are produced by reciprocating punches and complementary stationary dies across which waste solid or particulate organic materials are continuously passed. The reciprocating punches force the material into a reduced cross-sectional bore within each die, causing the formation of a pellet under controlled temperature conditions. The compresses material is permitted to gradually expand radially prior to leaving the die exit.

26 Claims, 8 Drawing Sheets

FIG 6
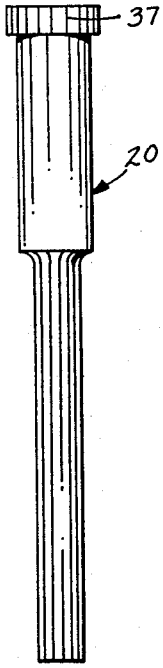
FIG 8
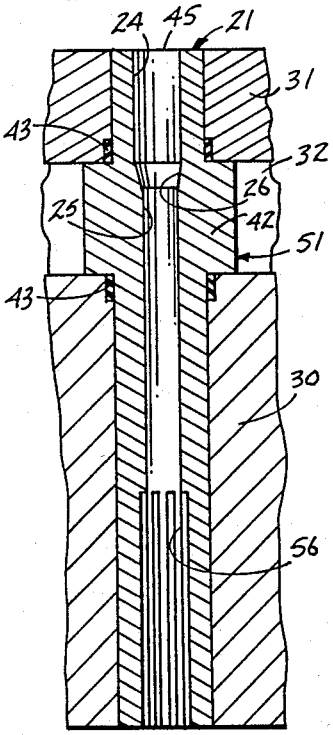
FIG 9
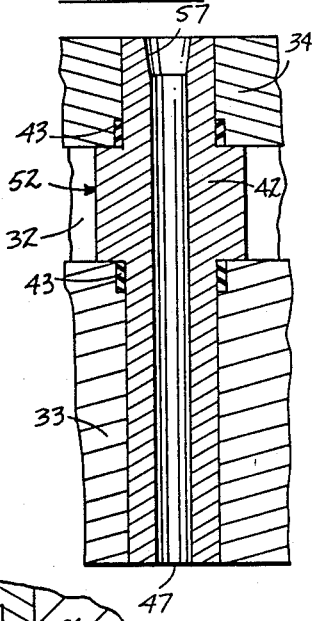
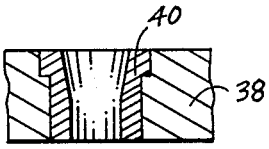
FIG 7
FIG 10
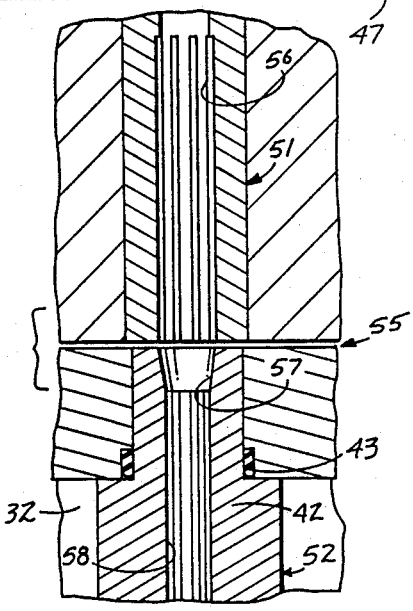

FUEL PELLETIZING APPARATUS AND METHOD

TECHNICAL FIELD

This disclosure relates to pelletizing equipment and processes for converting waste organic materials, such as wood, to small fuel pellets for fuel applications in commercial and residential systems.

BACKGROUND OF THE INVENTION

Pelletized fuel produced from organic waste, such as wood or garbage, is desirable for both industrial and household heating purposes because of its ability to be used with equipment that automatically handles and feeds the pellets to a chamber within which they are burned. Their small size, uniform diameter, and density permit automatic control of the burning process to a degree not practical in connection with the burning or incineration of raw waste materials.

Most fuel pellets today are produced by use of pelletizing equipment designed for pelletizing agriculatural feed. The use of such equipment requires that the waste material be reduced in size to particles capable of entering the pelletizing chambers within which they are compressed. Examples of U.S. patents dislosing such pelletizing processes are shown by U.S. Pat. Nos. 1,908,689; 4,234,561; 4,308,033 and 4,015,951. Pretreating of materials for pelletizing is disclosed in U.S. Pat. No. 4,398,917 and in U.S. Pat. No. 4,561,860.

A very early disclosure of a compressed fuel briquette for burning purposes is shown in U.S. Pat. No. 959,870, which was patented May 31, 1910.

The present disclosure relates to production of pellets without the necessity of reducing the size of the incoming waste materials or modifying their moisture content. It is designed for commercial production of pellets at high volumes by continuously feeding waste material between reciprocating punches and stationary dies within which the material is compressed to a small cylindrical configuration.

BRIEF DESCRIPTION OF THE DRAWINGS

The preferred embodiment of the invention is illustrated in the accompanying drawings, in which:

FIG. 1 is a partial fragmentary side view of the pelletizing machine;

FIG. 6 is an elevational view of a punch;

FIG. 7 is an elevational section view through a guide bushing;

FIG. 8 is an elevational section view through an upper die element;

FIG. 9 is an elevational section view through a lower die element;

FIG. 10 is an elevational section view through the adjacent portions of the die elements;

FIG. 12 is a plan view of a modified die assembly; and

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

Figure 11:
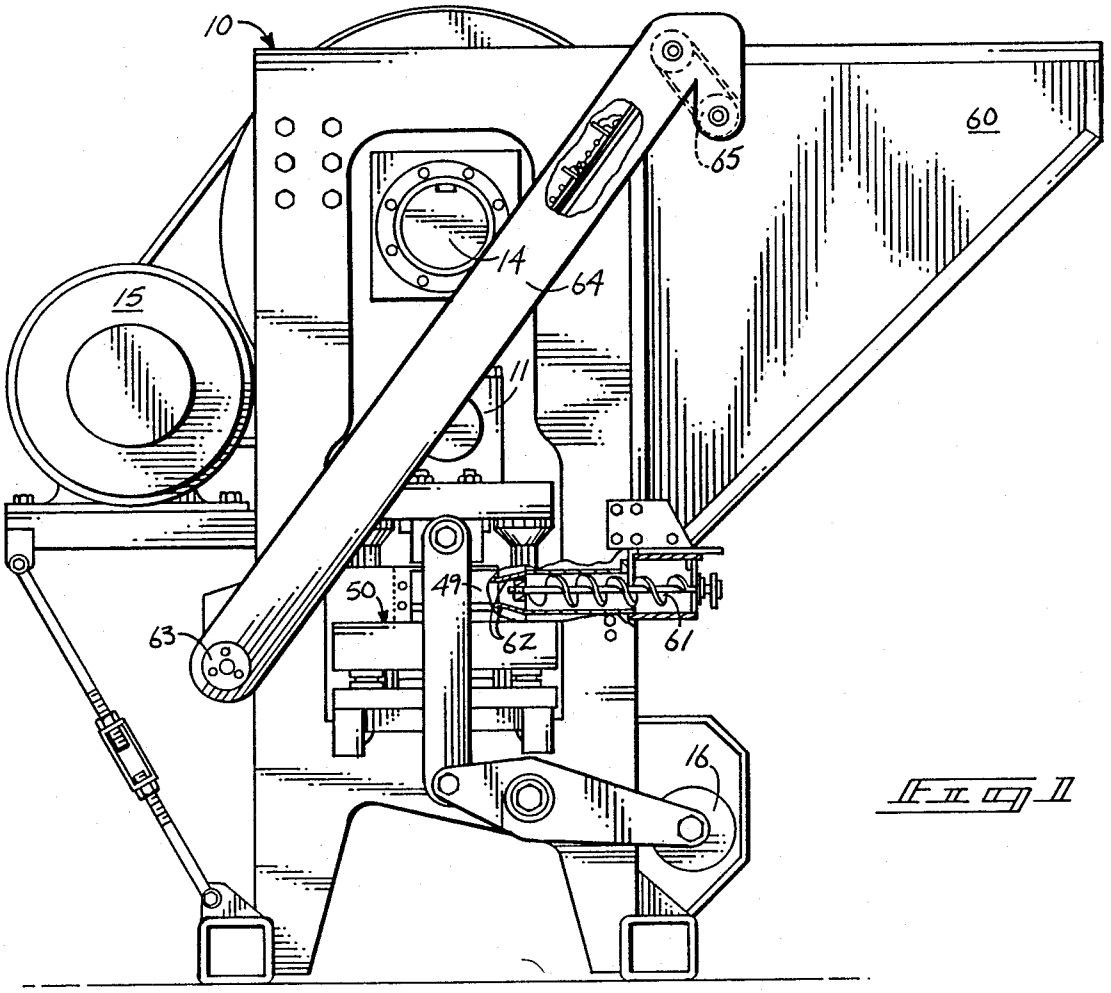
FIG. 11 is a plan view of the guide holder, taken along line 11—11 in FIG. 2.
Figure 2:
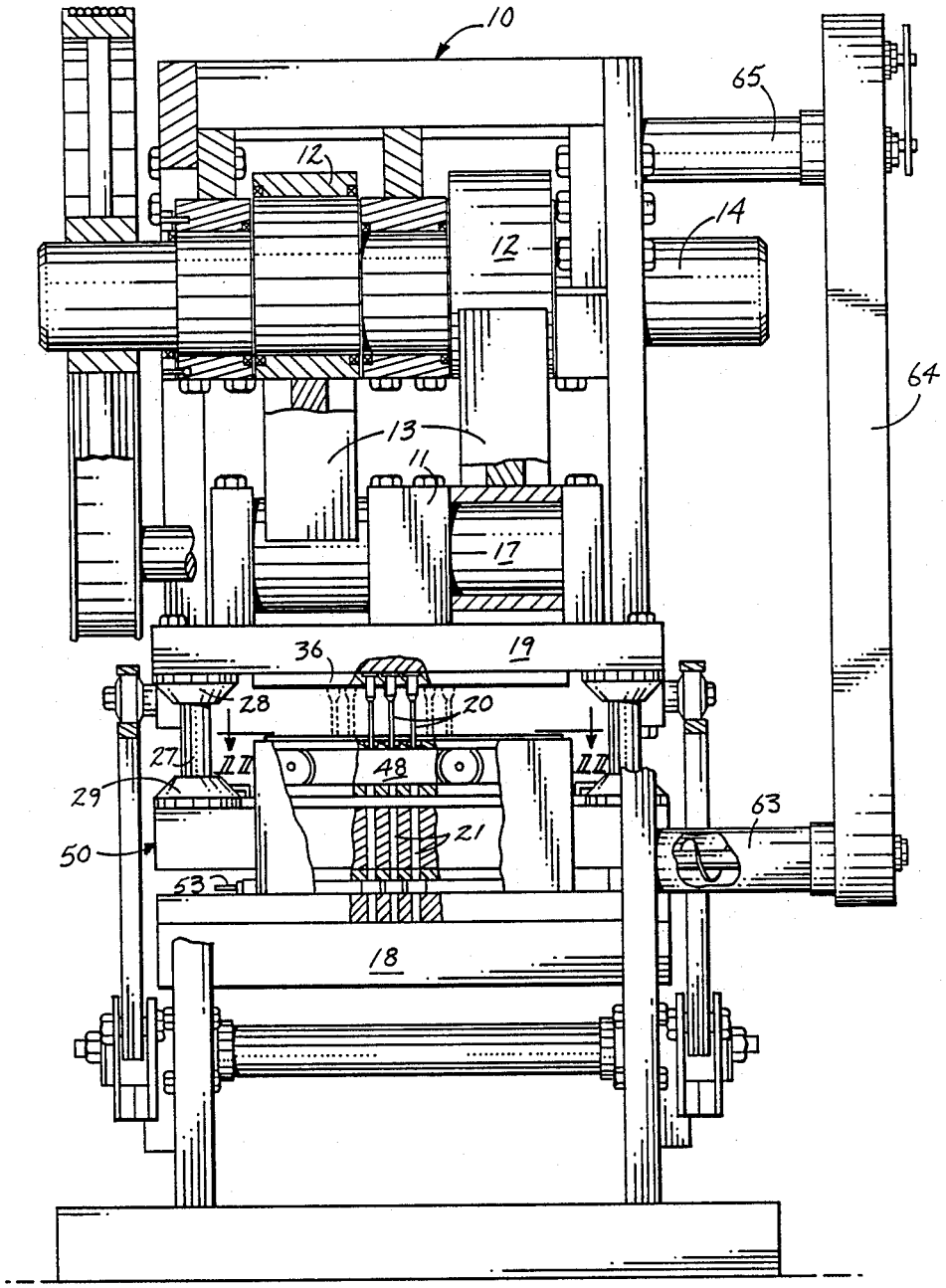
FIG. 2 is a partial fragmentary rear view.
Figure 3:
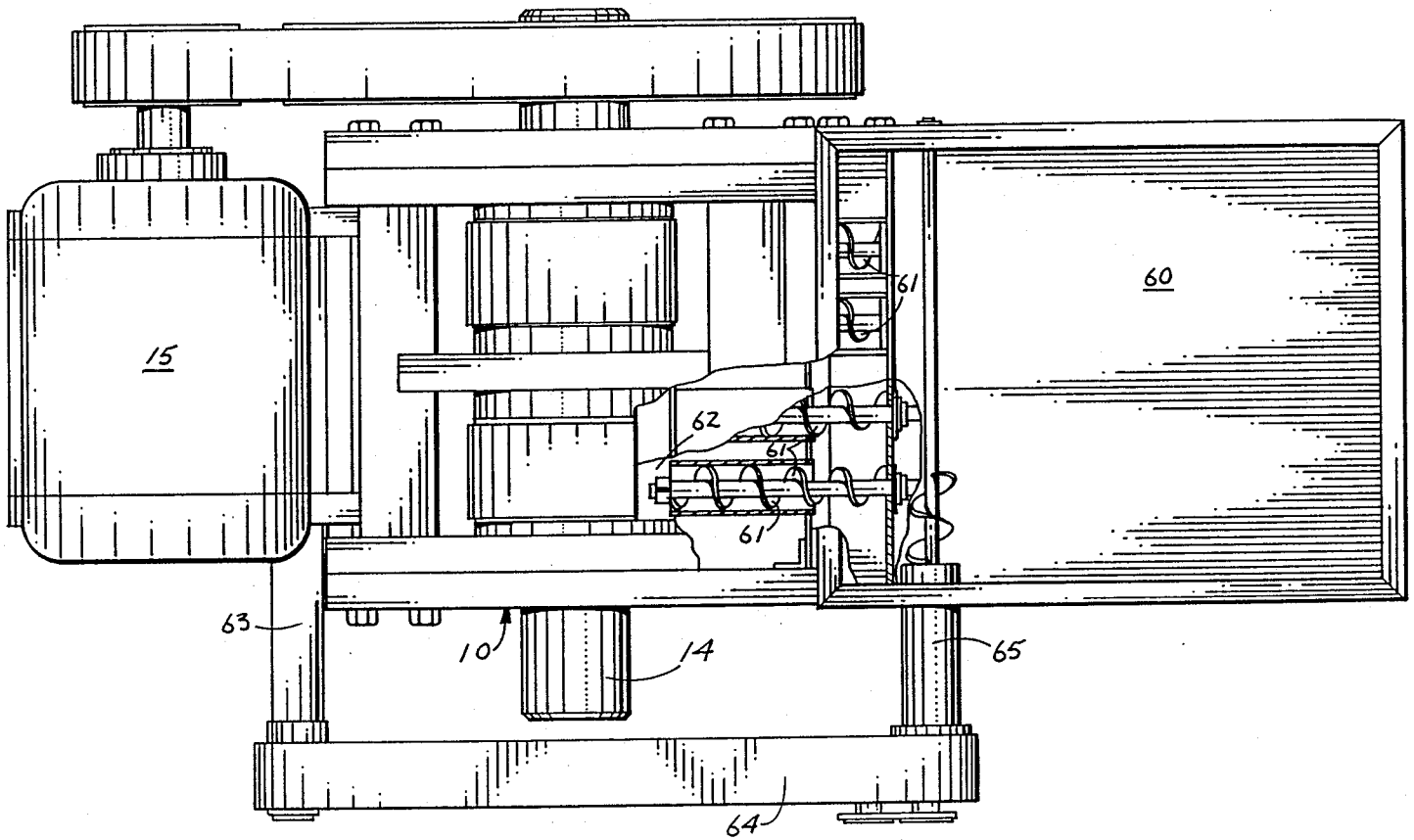
FIG. 3 is a partial fragmentary top view.
Figure 4:
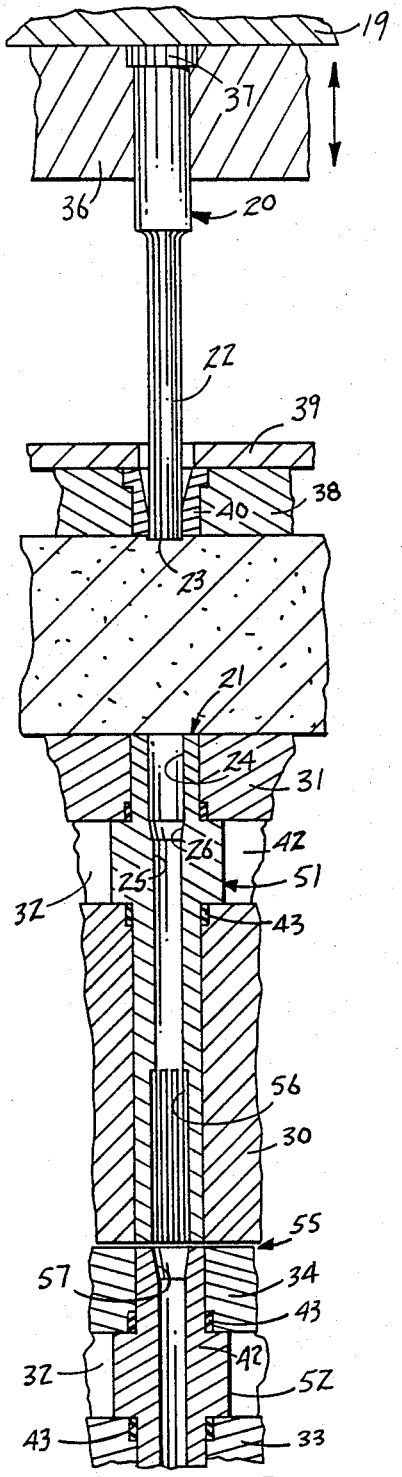
FIG. 4 is an enlarged vertical sectional view through a single punch and die combination, with the punch retracted.

The machine used for producing small fuel pellets according to this disclosure is incorporated within a punch press. Illustrative details of the punch press are shown in FIGS. 1 through 3, but the punch press itself might be varied substantially depending upon size and power requirements encountered in a particular situation. The reciprocating mechanical elements of the punch press itself are essentially conventional and common to such machines that typically change the size or shape of a piece of material, usually sheet metal, by applying pressure to a die in which the workpiece is held. The form and construction of the punch and die in a conventional punch press determine the shape produced on the workpiece.

As is conventional, the illustrated punch press 10 has two coacting components; a punch, which is attached to the reciprocating ram 11 of the machine, and a die, which is fixed to a stationary peripheral bolster 18 located beneath the ram 11. As described in detail below, ram 11 reciprocated a plurality of parallel punches 20 that are individually axially aligned with a complementary set of dies 21.

Instead of blanking, forming, bending or drawing metal, as is usually accomplished in such a punch press, the punch press 10 is used to direct individual charges of flowable solid organic material into the dies, where the material is subsequently compressed, heated or cooled (as necessary), and permitted to gradually expand under controlled conditions to release interior gases and vapors before being ejected or extruded from the equipment as compressed fuel pellets.

As in a conventional punch press, a motor 15 is used to drive an upper shaft 14 carrying eccentrics 12 that are operatively connected to a parallel shaft 17 on ram 11 by means of connecting rods 13. A counterweight 16 provided on the machine is operatively connected to ram 11 to move in opposition to it and to effectively balance the weight of the ram and minimize the power requirements of the punch press 10. The array of elongated punches 20 extend downwardly from a solid punch press 19 on ram 11 along parallel axes. The individual punches (detailed in FIG. 6) have an upper end capped by a protruding cylindrical shoulder 37 which is fitted within a complementary recess formed in a solid punch clamp 36 that is rigidly bolted to the underside of punch plate 19.

Each punch 20 has an axial cylindrical outer end section 22 of constant outside diameter. The cylindrical outer end sections 22 of the punches terminate at transverse circular end surfaces 23. The length of each punch section 22 is greater than the stroke of the punch press.

A die assembly 50 is bolted rigidly to the upper surfaces of bolster 18 and serves as the stationary element in the punch press 10. The moving ram 11 is guided on the die assembly 50 by means of parallel guide posts 27, whose upper ends are fixed within guide post mounts 28. The guide posts 27 slide within boss bushings 29 mounted to the die assembly 50 to limit the reciprocating movement of ram 11 to a straight line vertical direction.

The dies 21 are arranged in an array complementary to the array of punches 20 with the individual dies 21 axially aligned with individual punches.

The first embodiment of die assembly 50, shown in detail in FIGS. 1 through 5 and FIGS. 8 through 10, is a two piece die, comprising upper and lower die elements 51 and 52. The upper die elements 51 are held by gripping enlarged exterior shoulders 42 between a solid upper die holder 30 and an overlying upper die clamp 31, while the lower die elements 52 are held by also gripping shoulders 42 between a similar lower die holder 33 and lower die clamp 34.

A stationary guide holder 38 is spaced vertically above the upper die clamp 31. It is supported by a pair of transversely spaced sidewalls 49. The upper surface of clamp 31, the bottom surface of guide holder 38 and the inside surfaces of the two walls 49 define a feed chamber 48 through which flowable solid organic materials such as wood waste, can be directed or advanced for pelletizing purposes.

Individual guide bushings 40 are coaxially aligned with the punches 20. They are held in place within the guide holder 38 by an overlying guide clamp 39.

The vertical spaced between the die holders 30, 33 and their overlying clamps 31, 34 are hollow and surrounded by peripheral sealed walls 32. The dies 21 are sealed with respect to the die holders and die clamps by compressed O-ring seals 43 (FIG. 4 and 5), assuring a liquid seal within the hollow chambers that surround the radially enlarged die shoulders 42 that space the die holders from the die clamps. Liquid connections 53 are provided to external heat exchangers (not shown) to permit regulation of die temperatures by heat transfer to the exterior surfaces of each die element about the shoulders 42.

The nature of each die 21 in the first embodiment of this invention can best be understood from FIGS. 4, 5 and 8–10. The upper die element has a first bore section 24 that leads to a die entrance 45 that faces toward the coaxially aligned guide bushing 40 for receiving the punch 20 axially aligned with it. The first bore section is followed by a downstream second coaxial bore section 25 that leads to a die exit 47 that faces oppositely from the guide bushing 40.

The first bore section 24 is cylindrical in shape and complementary in cross-sectional size to the cross-sectional size of the outer cylindrical punch end 22. A tapered transition zone 26 leads to the second bore section 25. The second bore section 25 is of reduced cross-sectional size in comparison to the cross-sectional size of the first bore section 25. The smaller cross-sectional size results in the compression of material forced axially through the die by operation of the punch press 10.

Figure 5:
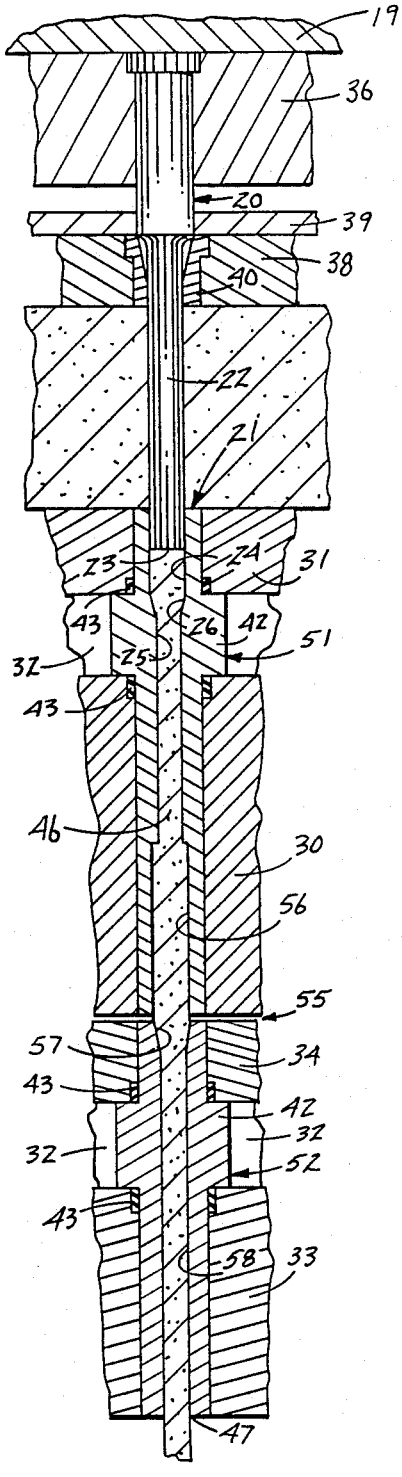
FIG. 5 is a similar view with the punch extended.
Figure 11:
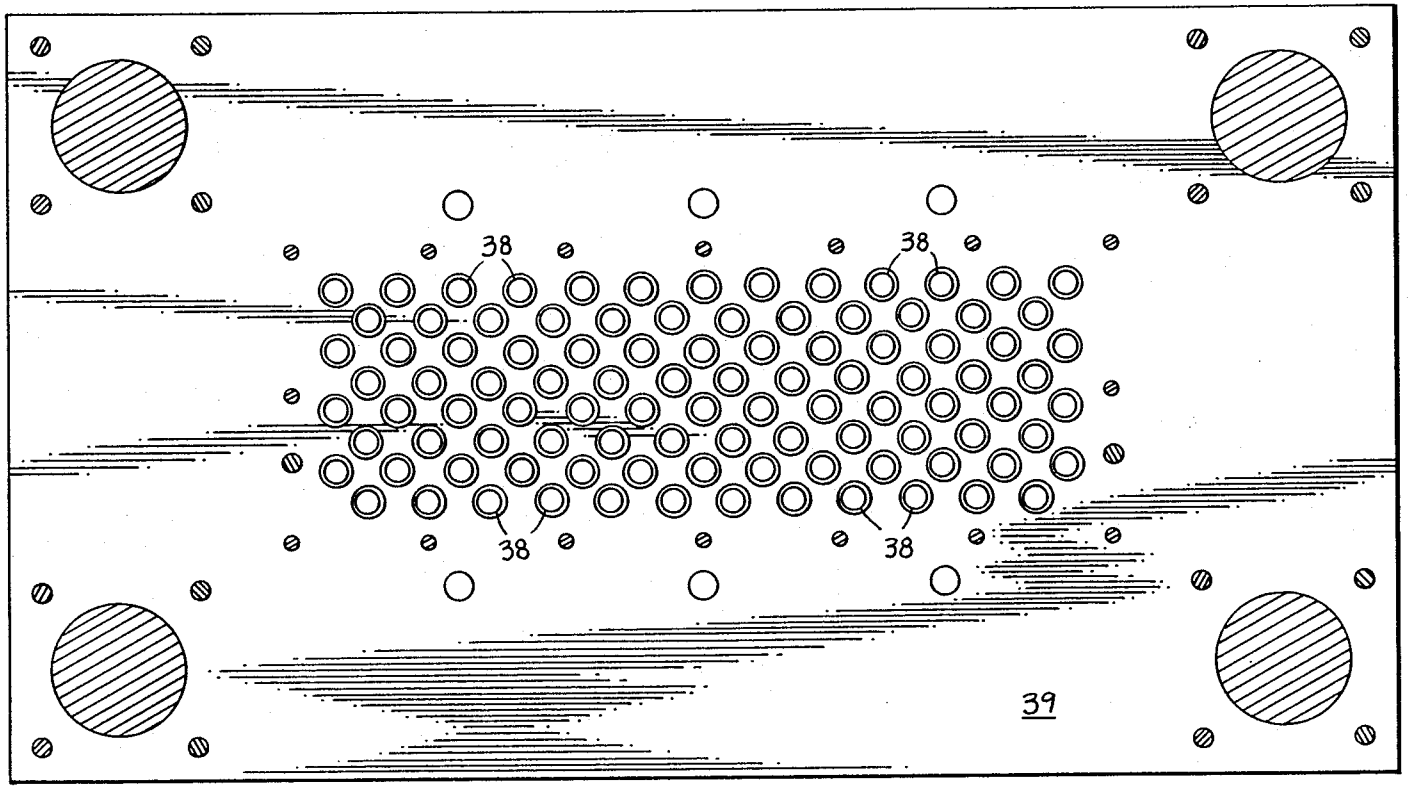
Figure 11:
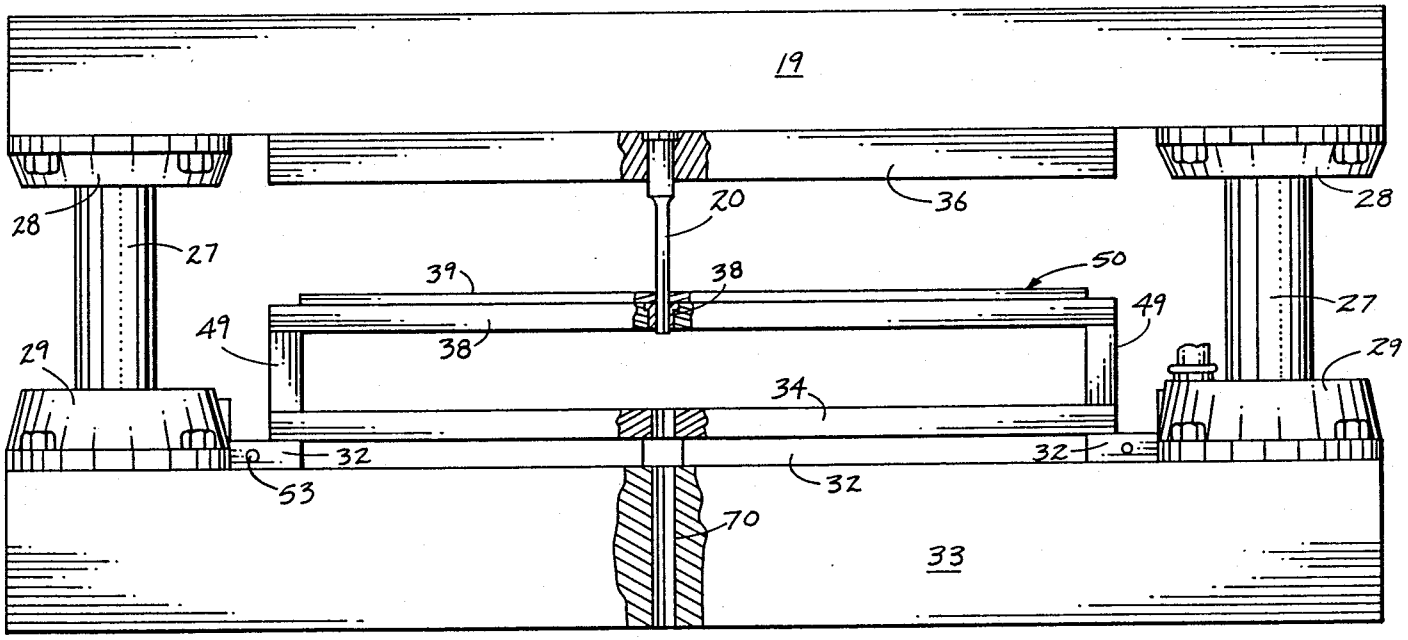

The second bore section 25 of each die is exteriorly vented to permit controlled relief of gas and steam from within the compressed material located within them prior to release of the material through the die exit 47. In FIG. 5, the compressed material being pelletized is shown at 46. In this first embodiment of the invention, venting occurs across an open axial gap 55 between upper die element 51 and the lower die element 52. Gap 55 can be controlled in size by use of spacers (not shown).

To facilitate release of gas and steam from within the compressed material 46, the lower portion of the second bore section 25 leading to the bottom end of the upper die element 51 is interrupted by radially enlarged axial grooves 56. They extend axially from the gap 55 toward the first bore section 24 for accommodating gradual radial expansion of the material. Groove 56 also score the surface of the compressed material 46 in the second bore section 25 as it expands radially prior to passage across gap 55.

The second bore section 25 of each die is also interrupted by a second axially tapered transition zone 57 extending from the downstream edge of gap 55 to a location axially spaced inwardly from the die exit 47. The second transition zone 57 has a diameter at the edge of gap 55 at least equal to the maximum diameter of the groove 56. It is located at the upper end of the lower die element 52. It recompresses the material 46 that had expanded into the grooves 56 after passage of the material across the venting gap 55. The tapered zone 57 is followed by an elongated cylindrical bore section 58 that is of the same inside diameter as the cylindrical bore section between the transition zone 26 and the grooves 56.

Referring now to FIGS. 1, 2 and 3, an upwardly open hopper 60 is provided directly adjacent to the punch press 10 for receiving flowable solid organic material of size capable of passage through the feed chamber 48. A powered conveyor, which includes four parallel augers 61, feeds material from the bottom of hopper 60 to the feed chamber 48. The downstream ends of the augers 61 direct the material into a compression chamber formed by tapered walls 62 that taper to the spacing between the guide holder 38 and the upper die holder 30. The resulting compression of feed material assures that the feed chamber 48 is full at all times.

The material exiting from the feed chamber 48 drops into a transverse receiving auger conveyor 63 that shifts it to an elevating conveyor assembly 64. The upper end of the conveying assembly 64 is provided with a transverse auger conveyor 65 that returns the feed material to the interior of hopper 60 for recycling purposes.

The various conveyors for the feed material, including augers 61, preferably operate continuously during operation of punch press 10. They can be driven by a common motor (not shown) provided for this purpose.

The above-described machine is particularly adapted to forming fuel pellets from wood waste, the pellets having a diameter of 0.25 to 0.38 inches. The length of each pellet varies, depending upon where the material 46 breaks as it leaves the die exit 47. The die assembly has been found to be capable of handling waste wood materials, including solid pieces and dust, having moisture content of 15% or less by weight. It is adaptable to forming pellets from wood waste, organic garbage, and even solid board stock.

To successfully produce pellets, it is desirable that the die temperatures be maintained between 250° to 350° F. depending upon the nature of the incoming feed material. This can require either heating or cooling of the die elements 51, 52 by means of the heat exchangers that surround them.

Figure 13:
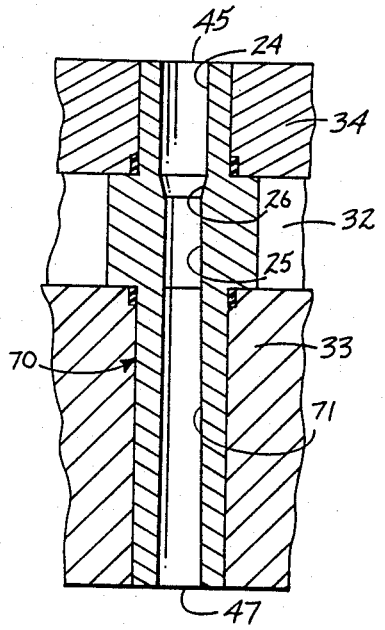
FIG. 13 is a view similar to FIG. 8 showing the modified die components.

FIG. 12 shows a modified die assembly that forms a second and preferred embodiment of the disclosure. The die details are shown in FIG. 13. The punch 20 and associated guide bushing 40 are identical to those disclosed in FIGS. 6 and 7, respectively.

The modified die assembly shown in FIG. 12 eliminates the lower die holder 33, the lower die element 52, and the components associated with them. Numerals identical to those in the earlier drawings are used in FIG. 12 for reference purposes. The basic distinction in this embodiment is the use of a shorter die 70, which has a first bore section 24 and a transition zone 26 as previously described, followed by a constant diameter bore section 66 extending substantially through the length of the surrounding die shoulder 42. The distinction between the die structures lies in the portion 71 of the second bore section 25 extending beneath the die shoulder 42. This portion of the bore is tapered, and progressively increases in diameter to its intersection with the die exit 47. The taper of the bore portion 71 gradually increases in diameter to an inside diameter greater than that of the expanded material being extruded through the die by operation of punch 20. As an example, if the bore section 25 is 0.250 inches in diameter, the exit diameter of the succeeding bore portion 71 might of 0.300 inches in diameter. It has been found that the pressed pellets will not expand to that diameter, thus leaving a space between the pellet material and the sidewalls of the bore portion 71 through which gas and steam can be vented prior to the passage of the material through the die exit 47. This assures that gas and steam will be vented due to the expansion of the pellet which will occur within the die, while at the same time assuring that this release will occur as the material expands radially and gradually while the pellet is surrounded by the die so as to prevent disintegration of the pellet due to a rapid explosive effect.

The method of producing small fuel pellets form a mass of solid organic material by use of the above machine involves first the step of forcing the array of reciprocating parallel punches 20 simultaneously through the mass of solid organic material within the feed chamber 48 and into the receiving complementary array of dies. The material is compressed as it is forced through the first bore section 24 leading to the die entrance 45 for receiving the outer cylindrical end 22 of an aligned punch 20. The material is subsequently forced through a second die section 25 of reduced cross-sectional size for compressing the material as it is forced axially through the die 21 by operation of the punch 20. Pellets are formed as the punches 20 are successively operated to cause the material to be released from the die exits 47. During this process, the compressed material 46 within die 21 is permitted to gradually expand radially under controlled conditions and is exteriorly vented while within the second bore section 25 of each die 21 and prior to its release through the die exit 47. This can be achieved by use of a combination of expanding rifle grooves 56 and an open gap 55 in the die 21 or by permitting controlled expansion of the compressed material 46 through an elongated tapered bore portion 71 (FIG. 13).

The above-described machine and method have demonstrated an ability to produce useful fuel pellets from waste organic materials having moisture contents that need not be substantially reduced from available waste supply sources. Pellet densities above 75 pounds per cubic foot have been consistently produced in pellets of 0.250 inch diameter, using softwood and hardwood waste. The machine does not require that the incoming material be reduced in size to a size less than that of the bore through which it is compressed, since the punch and die combination simultaneously sizes and feeds incoming material through the dies without any need for such size reduction in preparation for the pelletizing process.

In compliance with the statue, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A pelletizing apparatus for producing small fuel pellets from a mass of flowable solid organic material comprising:

a reciprocating punch press having a movable punch plate and a stationary die holder;

stationary guide means interposed between the punch plate and the die holder, the guide means and die holder being spaced apart from one another to present a feed chamber for advancing flowable solid organic material;

an array of elongated punches extending from the punch plate along parallel axes, the individual punches being slidably received through complementary openings formed through the guide means;

a complementary array of dies in the die holder, the individual dies being axially aligned with individual punches in the array of punches for receiving the punches after their passage through the feed chamber;

each die having a first bore section leading to a die entrance that faces toward the guide means for receiving the punch axially aligned with it, the first bore section being followed by a downstream second coaxial bore section that leads to a die exit that faced oppositely from the guide means, the second bore section being of reduced cross-sectional size in comparison to the cross-sectional size of the first bore section for radially and axially compressing material forced through the die by operation of the punch press; and feed means for continuously directing a stream of compressed solid flowable organic material into the feed chamber.

2. The pelletizing apparatus of claim 1 wherein each punch has an axial cylindrical outer end section of constant outside diameter terminating at a transverse circular end surface;

the cross-sectional configuration of the first bore section of each die has a cylindrical shape of constant inside diameter capable of receiving the outer end section of the punch with which it is axially aligned.

3. The pelletizing apparatus of claim 1 wherein each punch has an axial cylindrical outer end section of constant outside diameter terminating at a transverse circular end surface;

the cross-sectional configuration of the first bore section of each die has a cylindrical shape of constant inside diameter capable of receiving the outer end section of the punch with which it is axially aligned;

the second bore section of each die having a cylindrical shape of constant inside diameter that is less than the outside diameter of the punch with which it is is axially aligned.

4. The pelletizing apparatus of claim 1 wherein the first and second bore sections of each die are merged by an axially tapered transition zone.

5. The pelletizing apparatus of claim 1 wherein the second bore section of each die is exteriorly vented to permit controlled release of gas and steam from within compressed material located within the prior to release of the material through the die exit.

6. The pelletizing apparatus of claim 1 wherein the second bore section of each die includes a tapered bore configuration of gradually increasing interior diameter leading to the die exit.

7. The pelletizing apparatus of claim 1 wherein the second bore section of each die includes a tapered bore configuration of gradually increasing interior diameter leading to the die exit, the interior diameter of the second bore section at the die exit being greater than the exterior diameter of the compressed material passing through it.

8. The pelletizing apparatus of claim 1 wherein the second bore section of each die includes a bore configuration permitting gradual radial expansion of the compressed material prior to its passage through the die exit.

9. The pelletizing apparatus of claim 1 further comprising:

heat exchanger means surrounding each die for maintaining a constant die temperature during operation of the punch press.

10. The pelletizing apparatus of claim 1 further comprising:

heat exchanger means surrounding each die for maintaining a constant die temperature during operation of the punch press;

the constant temperature being in the range of 250° to 350° F.

11. The pelletizing apparatus of claim 1 wherein the feed means comprises:

hopper means for receiving flowable solid organic material of a size capable of passage through the feed chamber; and powered conveyor means leading between the hopper means and the feed chamber for directing flowable solid organic material from the hopper into the feed chamber.

12. The pelletizing apparatus of claim 1 wherein the feed means comprises:

hopper means for receiving flowable solid organic material of a size capable of passage through the feed chamber; and powered conveyor means leading between the hopper means and the feed chamber for directing flowable solid organic material from the hopper into the feed chamber;

the pelletizing apparatus further comprising return conveyor means for directing material back to the hopper means after passage through the feed chamber.

13. The pelletizing apparatus of claim 12 further comprising drive means operably connected to the auger conveyor means and to the return conveyor means for power them continuously during operation of the punch press.

14. The pelletizing apparatus of claim 1 wherein the feed means comprises:

hopper means for receiving flowable solid organic material of a size capable of passage through the feed chamber; and powered conveyor means leading between the hopper means and the feed chamber for directing flowable solid organic material from the hopper into the feed chamber; the powered conveyor means including a compression chamber that tapers to the spacing between the guide means and the die holder.

15. The pelletizing apparatus of claim 1 further comprising:

a pair of side plates extending between the guide means and the punch plate at opposite sides of the feed chamber.

16. A punch and die assembly for producing small fuel pellets from a mass of flowable solid organic material, comprising:

an array of elongated punches;

a complementary array of dies, the individual dies being axially aligned with individual punches in the array of punches;

each die having a first bore section leading to a die entrance for receiving the punch axially aligned with it and a downstream second coaxial die section leading to die exit, the second die section being of reduced size for radially and axially compressing material forced through the die by operation of the punch; and wherein the second bore sections of each die are exteriorly vented to permit release of steam from within compressed material located within them prior to release of the material through the die exit.

17. A punch and die assembly for producing small fuel pellets from a mass of flowable solid organic material, comprising:

an array of elongated punches;

a complementary array of dies, the individual dies being axially aligned with individual punches in the array of punches;

each die having a first bore section leading to a die entrance for receiving the punch axially aligned with it and a downstream second coaxial die section leading to die exit, the second die section being of reduced size for radially and axially compressing material forced through the die by operation of the punch; and wherein the second bore section of each die includes a tapered bore configuration of gradually increasing interior diameter leading to the die exit.

18. The pelletizing apparatus of claim 17 wherein the interior diameter of the second bore section at the die exit is greater than the exterior diameter of the compressed material passing through it.

19. The pelletizing apparatus of claim 17 wherein the second bore section of each die includes a bore configuration permitting gradual radial expansion of the compressed material prior to its passage through the die exit.

20. A method for producing small fuel pellets from a mass of flowable solid organic material comprising the following steps:

intermittently forcing an array of reciprocating parallel punches simultaneously through a mass of flowable solid organic material and into a complementary array of dies as the organic material is continuously directed across the punches in a compressed stream, each die having a first bore section leading to a die entrance for receiving the punch axially aligned with it and a downstream second coaxial bore section leading to die exit, the second bore section being of reduced cross-sectional size for radially and axially compressing material forced through the die by operation of the punch; and successively operating the punches to cause pelletized material to be released from the exit ends of the array of dies.

21. The method of claim 20 further comprising the step of forcing material within the die through an axially tapered transition zone that merges its first and second bore sections.

22. The method of claim 20 further comprising the step of exteriorly venting the material within second bore section of each die prior to its release at the exit end of the die.

23. The method of claim 22 further comprising the step of permitting compressed material within the second bore section of each die to expand radially into axial grooves that score the surface of the compressed material immediately prior to the venting step.

24. The method of claim 20 further comprising the step of permitting the compressed material within the second bore section of each die to gradually expand radially prior to its passage from the die.

25. The method of claim 20 further comprising the steps of permitting the compressed material within the second bore section of each die to expand radially into a tapered bore configuration of gradually increasing interior diameter leading to the die exit.

26. The method of claim 20 further comprising the following steps:

collecting flowable solid organic material that is not forced into the dies and redirecting such material across the array of reciprocating punches for subsequent engagement by said punches and dies.

* * * * *